US011386773B1

(12) United States Patent
Kitazawa

(10) Patent No.: US 11,386,773 B1
(45) Date of Patent: Jul. 12, 2022

(54) FIRE ALARM SYSTEM

(71) Applicant: Mitsubishi Electric Corporation, Tokyo (JP)

(72) Inventor: Koki Kitazawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/343,020

(22) Filed: Jun. 9, 2021

(30) Foreign Application Priority Data

Jan. 15, 2021 (JP) ..... JP2021-004635

(51) Int. Cl.
*G08B 29/14* (2006.01)
*H05B 45/50* (2022.01)

(52) U.S. Cl.
CPC ..... *G08B 29/145* (2013.01); *H05B 45/50* (2020.01)

(58) Field of Classification Search
CPC ..... G08B 29/145; G08B 17/00; G08B 17/10; G08B 17/103; G08B 17/107; G08B 17/113; H05B 45/50; G01N 15/06; G01N 2015/0693
See application file for complete search history.

(56) References Cited

U.S. PATENT DOCUMENTS 4,481,502 A * 11/1984 Dawson ..... G08B 29/145 340/629
5,189,399 A * 2/1993 Beyersdorf ..... G08B 17/11 250/385.1
5,764,142 A * 6/1998 Anderson ..... G01D 3/032 340/630
2003/0160703 A1 8/2003 Kurose
2011/0240798 A1* 10/2011 Gershzohn ..... G08B 17/00 244/129.2
2012/0229285 A1* 9/2012 Rauworth ..... G08B 21/14 340/628
2013/0334417 A1* 12/2013 Lewiner ..... G01N 33/0009 250/338.5
2014/0009280 A1* 1/2014 Takahashi ..... G08B 26/008 340/538
2014/0240105 A1* 8/2014 Brenner ..... G08B 25/00 340/286.02
2018/0211514 A1* 7/2018 Bajaj ..... G08B 29/145

FOREIGN PATENT DOCUMENTS

JP 2003249383 A 9/2003

* cited by examiner

*Primary Examiner* — Curtis J King
(74) *Attorney, Agent, or Firm* — Buchanan Ingersoll & Rooney PC

(57) ABSTRACT

Pulse voltage is applied to an alarm device a plurality of times consecutively, the pulse voltage having such a short time length that the alarm device does not issue a noticeable alarm. Power consumption for each of the pulse voltages is measured. Any of an average value of the plurality of power consumptions, a maximum value of the plurality of power consumptions, or a minimum value of the plurality of power consumptions, is calculated as a statistical value. When a difference between the statistical value and a predetermined reference value is greater than a predetermined threshold, it is determined that failure has occurred.

7 Claims, 6 Drawing Sheets

FIRE ALARM SYSTEM

BACKGROUND OF THE INVENTION

1. Field of the Invention

The present disclosure relates to a fire alarm system.

2. Description of the Background Art

A fire alarm system is required to assuredly issue an alarm when fire is detected. Therefore, it is desirable to perform, in an ordinary time, failure diagnosis for an alarm device which informs that fire occurs. In a case of using an LED display light as the alarm device, proposed is a system that performs failure diagnosis for the LED display light by comparing, with a threshold, current flowing when pulse-shaped voltage is applied to the LED display light (see, for example, Patent Document 1).

Patent Document 1: Japanese Laid-Open Patent Publication No. 2003-249383

In the technology of Patent Document 1, current flowing when a single pulse-shaped voltage is applied to the alarm device is subjected to threshold processing, thereby detecting failure. In a fire alarm system, alarm devices may be installed over a wide range, so that wires for supplying power are elongated. In this case, noise is likely to be superimposed on current detected from the wires for supplying power. For example, if noise is superimposed when the single pulse-shaped voltage is applied, the noise is determined as abnormality of current due to failure, thus causing erroneous detection in failure diagnosis.

SUMMARY OF THE INVENTION

The present disclosure has been made to solve the above problem, and an object of the present disclosure is to provide a fire alarm system that is less likely to cause erroneous detection due to noise in failure diagnosis for an alarm device.

A fire alarm system according to one aspect of the present disclosure includes: an alarm device for issuing an alarm; and an alarm controller for applying voltage to the alarm device. The alarm controller applies pulse voltage to the alarm device a plurality of times consecutively, the pulse voltage having such a short time length that the alarm device does not issue a noticeable alarm. The alarm controller measures power consumption for each of the pulse voltages, and calculates, as a statistical value, any of an average value of the plurality of power consumptions, a maximum value of the plurality of power consumptions, or a minimum value of the plurality of power consumptions. When a difference between the statistical value and a predetermined reference value is greater than a predetermined threshold, the alarm controller determines that failure has occurred.

In the fire alarm system according to the present disclosure, pulse voltage is applied to the alarm device a plurality of times consecutively, the pulse voltage having such a short time length that the alarm device does not issue a noticeable alarm. Power consumption for each of the pulse voltages is measured. Any of an average value of the plurality of power consumptions, a maximum value of the plurality of power consumptions, or a minimum value of the plurality of power consumptions, is calculated as a statistical value. When a difference between the statistical value and a predetermined reference value is greater than a predetermined threshold, it is determined that failure has occurred. Thus, erroneous detection due to noise can be less likely to occur in failure diagnosis for the alarm device.

DETAILED DESCRIPTION OF THE PREFERRED EMBODIMENTS OF THE INVENTION

Figure 1:
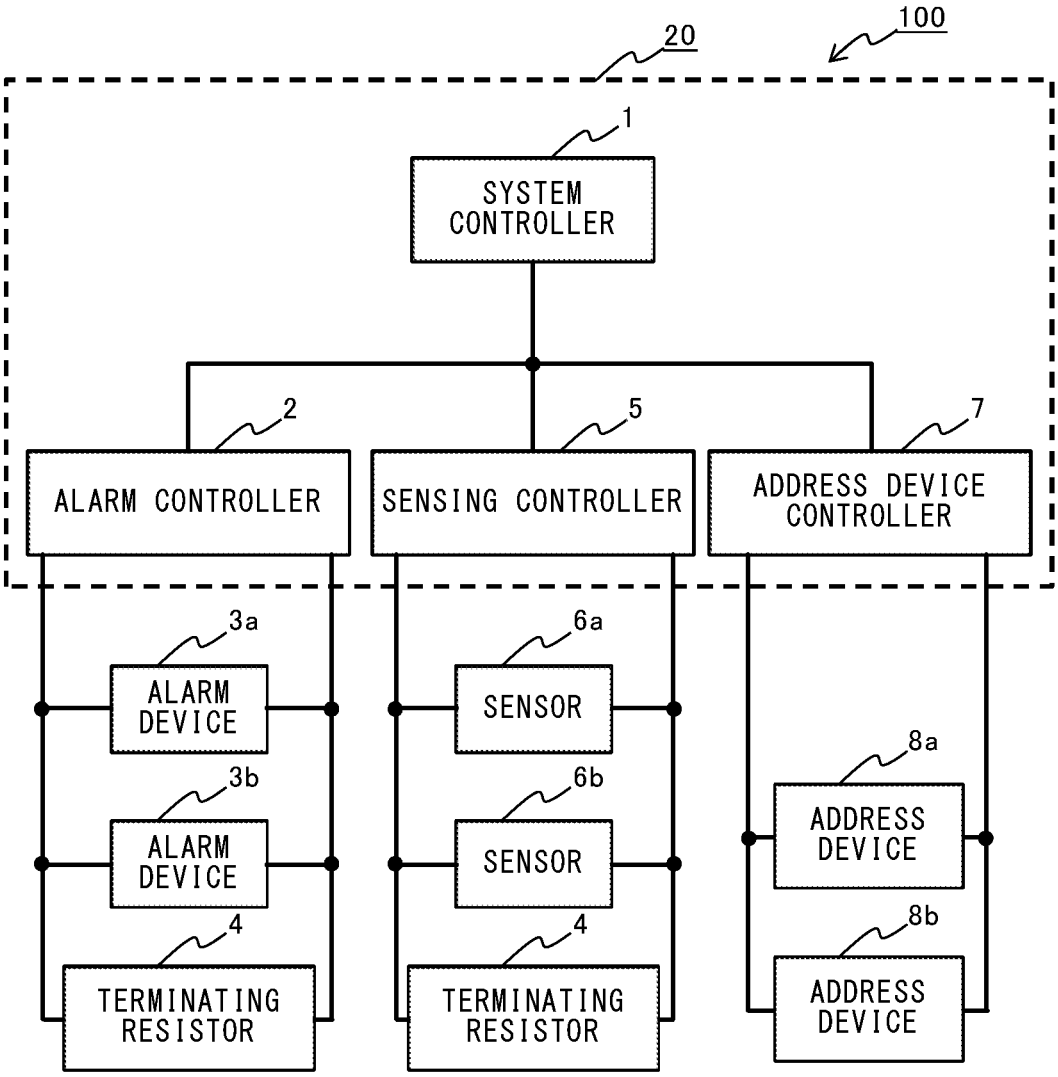
FIG. 1 is a block diagram showing the configuration of a fire alarm system according to the first embodiment of the present disclosure.

Hereinafter, fire alarm systems according to embodiments for carrying out the present disclosure will be described in detail with reference to the drawings. In the drawings, the same reference characters denote the same or corresponding parts.

First Embodiment

FIG. 1 is a block diagram showing the configuration of a fire alarm system 100 according to the first embodiment of the present disclosure. As shown in FIG. 1, the fire alarm system 100 includes a control panel 20, an alarm device 3*a*, an alarm device 3*b*, terminating resistors 4, a sensor 6*a*, a sensor 6*b*, an address device 8*a*, and an address device 8*b*. The control panel 20 includes a system controller 1, an alarm controller 2, a sensing controller 5, and an address device controller 7. The control panel 20 may be dedicated hardware or the function thereof may be realized through execution of a program. In a case of realizing the function through execution of a program, the hardware therefor is realized by a processor, a memory, an interface, and the like.

The system controller 1 controls the alarm controller 2, the sensing controller 5, and the address device controller 7. The sensor 6*a*, the sensor 6*b*, and the terminating resistor 4 are connected in parallel to the sensing controller 5 via lines serving as both of power supply lines and signal lines. The terminating resistor 4 is provided at the end of the lines connected to the sensing controller 5. The sensor 6*a* and the sensor 6*b* may be the same type or different types. In FIG. 1, two sensors, i.e., the sensor 6*a* and the sensor 6*b*, are connected to the sensing controller 5. However, any number of sensors may be connected to the sensing controller 5. The sensing controller 5 applies reference voltage of, for example, DC 24 V to the sensor 6*a* and the sensor 6*b*, to supply power. When the sensor 6*a* detects fire, the sensor 6*a* supplies notification current to the lines, and the sensing controller 5 detects the notification current flowing through the lines. When the notification current is detected in the sensing controller 5, the sensing controller 5 transmits a signal informing that fire is detected, to the system controller 1.

The alarm device 3*a*, the alarm device 3*b*, and the terminating resistor 4 are connected in parallel to the alarm controller 2 via lines serving as both of power supply lines and signal lines. The terminating resistor 4 is provided at ends of the lines connected to the alarm controller 2. The alarm device 3*a* and the alarm device 3*b* may be the same type or different types. In FIG. 1, two alarm devices, i.e., the alarm device 3*a* and the alarm device 3*b*, are connected to the alarm controller 2. However, any number of alarm devices may be connected to the alarm controller 2. When the system controller 1 has received the signal informing that fire is detected from the sensing controller 5, the system controller 1 transmits a signal informing that fire is detected, to the alarm controller 2. When the alarm controller 2 has received the signal informing that fire is detected, the alarm controller 2 applies reference voltage of, for example, DC 24 V to the alarm device 3*a* and the alarm device 3*b*, to supply power. The alarm device 3*a* and the alarm device 3*b* to which the reference voltage is applied issue alarms. The type of the alarms is, for example, sound or light, and may be any type that can inform a person about occurrence of fire.

The address device 8*a* and the address device 8*b* are connected in parallel to the address device controller 7 via lines serving as both of power supply lines and signal lines. The address device 8*a* and the address device 8*b* have individual addresses set thereon, and may be sensors, alarm devices, or other devices. In FIG. 1, two address devices, i.e., the address device 8*a* and the address device 8*b*, are connected to the address device controller 7. However, any number of address devices may be connected to the address device controller 7. The address device controller 7 applies reference voltage of, for example, DC 24 V to the address device 8*a* and the address device 8*b*, to supply power.

In a case where the address device is a sensor, when fire is detected, the address device supplies notification current to the lines, and the address device controller 7 detects the notification current flowing through the lines. When the notification current is detected in the address device controller 7, the address device controller 7 transmits a signal informing that fire is detected, to the system controller 1.

In a case where the address device is an alarm device, when fire is detected, the system controller 1 transmits a signal informing that fire is detected, to the address device controller 7, and the address device controller 7 transmits a signal informing that fire is detected, to the address device. The address device that has received the signal informing that fire is detected issues an alarm.

Next, failure diagnosis for the alarm devices in the fire alarm system 100 according to the first embodiment will be described. The alarm device 3*a* and the alarm device 3*b* may be configured such that, for example, polarities are imparted at their terminals connected to the alarm controller 2, and thus, when voltage is applied in the forward direction, an alarm is issued, and when voltage is applied in the reverse direction, current does not flow so that operation is not performed. In this case, in an ordinary time when fire is not detected, the alarm controller 2 applies voltage in the reverse direction to the lines to which the alarm device 3*a* and the alarm device 3*b* are connected, whereby, while the alarm device 3*a* and the alarm device 3*b* do not operate, current flows through the terminating resistor 4 provided at the end of the circuit, and thus it is possible to confirm whether or not there is disconnection or short-circuit in the circuit. However, with this method, it is impossible to find failure of the alarm device 3*a* and the alarm device 3*b*.

Accordingly, in the failure diagnosis of the fire alarm system 100 according to the first embodiment, in a case where the alarm device 3*a* and the alarm device 3*b* issue alarms only when voltage is applied in the forward direction, the alarm controller 2 applies pulse voltage in the forward direction to the alarm device 3*a* and the alarm device 3*b*. The voltage value of the pulse voltage at this time is equal to the reference voltage at which the alarm device 3*a* and the alarm device 3*b* issue alarms when fire is detected, and is, for example, DC 24 V. The pulse width of the pulse voltage is a time length short enough that the alarm device 3*a* and the alarm device 3*b* do not issue noticeable alarms that can be noticed by a person. For example, in a case where the alarm device emits sound, the pulse voltage is set to have a time length short enough that the emitted sound cannot be heard with ears, and in a case where the alarm device emits light, the pulse voltage is set to have a time length short enough that the emitted light cannot be seen with eyes. It is noted that, in a case where the alarm device 3*a* and the alarm device 3*b* issue alarms irrespective of the direction in which voltage is applied, the alarm controller 2 may apply voltage to the alarm device 3*a* and the alarm device 3*b* in either direction.

The alarm controller 2 applies such pulse voltage to the alarm device 3*a* and the alarm device 3*b* a plurality of times consecutively, and measures power consumption when each pulse voltage is applied. For example, if there is no voltage variation in the lines, current flowing through the lines connected to the alarm controller 2 may be measured to calculate power consumption. The alarm controller 2, for example, applies the pulse voltage ten times, and measures power consumption when each pulse voltage is applied, ten times in total.

Next, the alarm controller 2 calculates a statistical value of the power consumption values acquired a plurality of times consecutively. The statistical value is an average value, a maximum value, or a minimum value. When a difference between the calculated statistical value and a predetermined reference value is greater than a predetermined threshold, it is determined that failure has occurred in the alarm device 3*a*, the alarm device 3*b*, or the terminating resistor 4, and the alarm controller 2 transmits a signal informing that occurrence of failure in the alarm device 3*a*, the alarm device 3*b*, or the terminating resistor 4 is detected, to the system controller 1. In a case where, in an ordinary time, it has been confirmed that there is no failure in the terminating resistor 4 by applying voltage in the reverse direction to the lines to which the alarm device 3*a* and the alarm device 3*b* are connected, if the difference between the calculated statistical value and the predetermined reference value is greater than the predetermined threshold, it is determined that failure has occurred in the alarm device 3*a* or the alarm device 3*b*, and the alarm controller 2 transmits a signal informing that occurrence of failure in the alarm device 3*a* or the alarm device 3*b* is detected, to the system controller 1. The system controller 1 that has received the signal informing that occurrence of failure is detected, informs the user about occurrence of failure by means such as lighting up a lamp. If the difference between the calculated statistical value and the reference value is equal to or smaller than the threshold, determination is made as normal and the failure diagnosis is finished. When determination is made as normal, the alarm controller 2 may transmit a signal indicating that determination is made as normal, to the system controller 1, and may inform the user that failure diagnosis has been performed and determination is made as normal, by means such as lighting up a lamp.

In the fire alarm system, the alarm devices may be installed over a wide range, so that the lines connected to the alarm controller 2 may be elongated. In this case, if a device that causes noise is present near the lines, noise is superimposed on the lines, and thus noise is superimposed on power consumption that is measured. Regarding the noise superimposed on the measured power consumption value, the average value during a certain period is often zero or a constant value without varying. Therefore, the pulse voltage is applied to the alarm device a plurality of times consecutively, power consumption for each pulse voltage is measured, and it is determined that failure has occurred if a difference between the average value of the power consumptions and the reference value is greater than the threshold, whereby the influence of noise can be reduced.

Noise superimposed on the measured power consumption value may occur intermittently. In this case, if failure detection is performed by performing threshold processing with current flowing when a single pulse-shaped voltage is applied to the alarm device, a value when noise is superimposed and a value when noise is not superimposed may greatly differ, and therefore, depending on setting of the reference value and the threshold, there is a case where failure cannot be detected or it is determined that failure has occurred even though failure has not actually occurred. Therefore, pulse voltage is applied to the alarm device a sufficient number of times over a sufficiently long time period for measuring power consumption including noise occurring intermittently, power consumption with respect to each pulse voltage is measured, and it is determined that failure has occurred if the difference between the reference value and the maximum value or the minimum value of power consumptions is greater than the threshold, whereby the influence of noise occurring intermittently can be reduced. In addition, in some alarm devices, power consumption increases or decreases temporarily or intermittently in a case of failure. Therefore, it becomes easy to find such failure by determining that failure has occurred if the difference between the reference value and the maximum value or the minimum value of power consumptions when pulse voltage is applied a plurality of times consecutively is greater than the threshold.

In a case where noise is repeated at a certain cycle and the cycle of noise is known in advance, the generation interval of the pulse voltage and the number of times of consecutive application of the pulse voltage may be set in accordance with the cycle of noise, whereby the influence of noise can be reduced. For example, the generation interval of the pulse voltage may be set to 1.1 times the time length of one cycle of noise, and the pulse voltage may be applied ten times consecutively, whereby data influenced by noises each shifted by 1/10 of one cycle can be acquired for one cycle, and thus the influence of noise can be reduced through comparison between the reference value and the average value, the maximum value, or the minimum value.

The reference value to be compared with the statistical value may be calculated from information about each of power consumptions acquired in advance for the alarm device 3*a*, the alarm device 3*b*, and the terminating resistor 4 connected to the alarm controller 2. Alternatively, reference voltage may be applied from the alarm controller 2 to actually operate the alarm device 3*a* and the alarm device 3*b*, and then power consumption when it is confirmed that each device normally issues an alarm may be stored, whereby the stored value may be used as the reference value.

In a case where the fire alarm system performs failure diagnosis a plurality of times, e.g., in a case where the fire alarm system performs failure diagnosis regularly, the statistical value determined as normal when calculated for failure diagnosis at any point of time in the past may be used as the reference value. In this case, failure diagnosis is performed on the basis of the value of power consumption obtained in the state of being actually determined as normal during operation, and therefore the failure diagnosis can be performed more accurately. If the calculation method for the statistical value in failure diagnosis is the same as the calculation method for a statistical value at any point of time in the past among the average value of power consumptions, the maximum value of power consumptions, and the minimum value of power consumptions, the statistical value at that point of time in the past may be used as the reference value, whereby the failure diagnosis can be performed further accurately. In a case where the fire alarm system performs failure diagnosis a plurality of times, for example, in a case where the fire alarm system performs failure diagnosis regularly, if the calculation method for the statistical value in failure diagnosis is the same as the calculation method for a statistical value in failure diagnosis in which determination has been made as normal at the previous time among the average value of power consumptions, the maximum value of power consumptions, and the minimum value of power consumptions, the statistical value calculated in the failure diagnosis in which determination has been made as normal at the previous time may be used as the reference value. In a case where the statistical value calculated in the failure diagnosis in which determination has been made as normal at the previous time is used as the reference value, it is possible to deal with power consumption change of the alarm device and noise change that are smaller than a threshold and within a normal range.

The threshold may be calculated from variation in each of power consumptions acquired in advance for the alarm device 3*a*, the alarm device 3*b*, and the terminating resistor 4 connected to the alarm controller 2, for example. In addition, after it is confirmed that the alarm device 3*a* and the alarm device 3*b* normally issue alarms when actually operated by application of reference voltage from the alarm controller 2, processing of applying pulse voltage for failure detection, measuring power consumption, and calculating the statistical value may be performed a plurality of times, and the threshold may be calculated from variation among the statistical values.

In the above description, the average value, the maximum value, or the minimum value is used as the statistical value. However, failure detection may be performed by calculating two or more of the average value, the maximum value, and the minimum value as the statistical values. In this case, failure detection is performed individually, using reference values and thresholds respectively corresponding to the average value, the maximum value, and the minimum value, and if it is determined that failure has occurred on the basis of any of the average value, the maximum value, or the minimum value, the alarm controller 2 transmits a signal informing that occurrence of failure is detected, to the system controller 1. Thus, it is possible to deal with different types of alarm devices and noises.

As described above, the fire alarm system according to the first embodiment includes the alarm devices 3*a*, 3*b* for issuing alarms, and the alarm controller 2 for applying voltage to the alarm devices 3*a*, 3*b*. The alarm controller 2 applies pulse voltage to the alarm devices 3*a*, 3*b* a plurality of times consecutively, the pulse voltage having such a short time length that the alarm devices 3*a*, 3*b* do not issue noticeable alarms. Then, the alarm controller 2 measures power consumption for each pulse voltage, and calculates, as a statistical value, any of an average value of the plurality of power consumptions, a maximum value of the plurality of power consumptions, or a minimum value of the plurality of power consumptions. When a difference between the statistical value and a predetermined reference value is greater than a predetermined threshold, the alarm controller 2 determines that failure has occurred. Thus, erroneous detection due to noise can be less likely to occur in the failure diagnosis.

Second Embodiment

Figure 2:
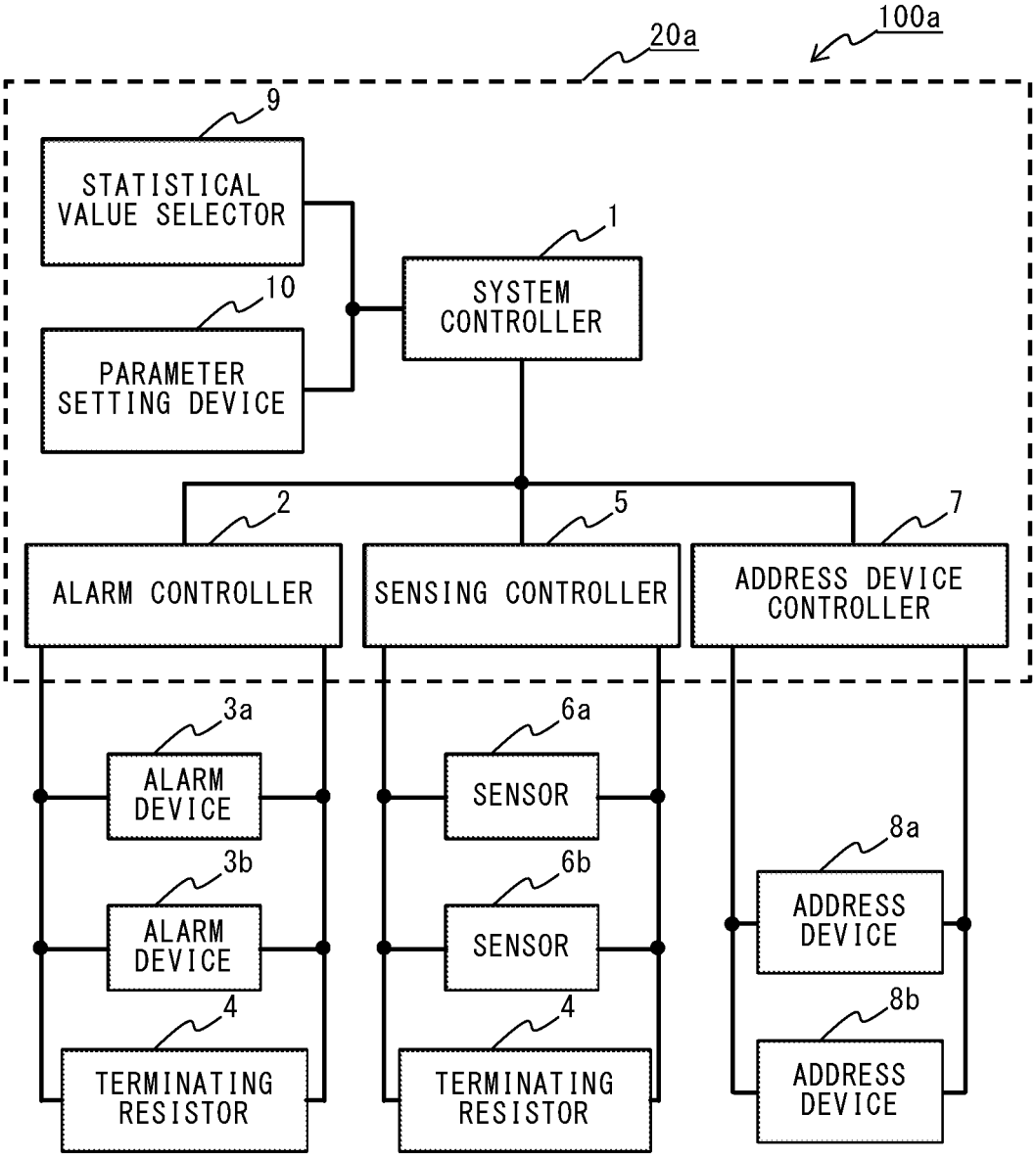
FIG. 2 is a block diagram showing the configuration of a fire alarm system according to the second embodiment of the present disclosure.

FIG. 2 is a diagram showing the configuration of a fire alarm system 100*a* according to the second embodiment of the present disclosure. In the fire alarm system 100*a* according to the second embodiment shown in FIG. 2, as compared to the fire alarm system 100 according to the first embodiment shown in FIG. 1, the control panel 20 is replaced with a control panel 20*a*, and a statistical value selector 9 and a parameter setting device 10 are added. The other configuration of the fire alarm system 100*a* according to the second embodiment is the same as the configuration of the fire alarm system 100 according to the first embodiment.

In the fire alarm system 100*a* according to the second embodiment shown in FIG. 2, the statistical value selector 9 selects, as the statistical value of the power consumption values acquired a plurality of times consecutively, which of the average value of the plurality of power consumptions, the maximum value of the plurality of power consumptions, and the minimum value of the plurality of power consumptions is to be used. The selection result is transmitted to the alarm controller 2 via the system controller 1, and the alarm controller 2 calculates the statistical value by the selected method. The statistical value selector 9 is, for example, an interface, and is realized by a switch, a keyboard, a touch panel, or the like. With the statistical value selector 9 provided, if addition, removal, or type change is made in the alarm devices connected to the alarm controller 2 or if noise superimposed on the lines connected to the alarm controller 2 is changed, in response thereto, it is possible to change the statistical value calculation method accordingly, whereby failure detection can be performed while adapting to such condition change.

In addition, in the fire alarm system 100*a* according to the second embodiment shown in FIG. 2, the parameter setting device 10 sets, as parameters, the "pulse width of pulse voltage" to be applied to the alarm device 3*a* and the alarm device 3*b*, the "generation interval of the pulse voltage", the "number of times of consecutive application of the pulse voltage", and the "reference value" and the "threshold" to be used for failure diagnosis. It is noted that, for example, in a case where the statistical value determined as normal when calculated for failure diagnosis at any point of time in the past is used as the reference value, the parameter to be set by the parameter setting device 10 is at least one of the "pulse width of pulse voltage", the "generation interval of the pulse voltage", the "number of times of consecutive application of the pulse voltage", and the "threshold" to be used for failure diagnosis. The set values are transmitted to the alarm controller 2 via the system controller 1, and are used for failure diagnosis in the alarm controller 2. The parameter setting device 10 is, for example, an interface, and is realized by a switch, a keyboard, a touch panel, or the like.

With the parameter setting device 10 provided, if addition, removal, or type change is made in the alarm devices connected to the alarm controller 2 or if noise superimposed on the lines connected to the alarm controller 2 is changed, in response thereto, it is possible to change the parameters accordingly, whereby failure detection can be performed while adapting to such condition change. The parameter setting device 10 may be configured to be capable of setting at least one of the pulse width of pulse voltage, the generation interval of the pulse voltage, the number of times of consecutive application of the pulse voltage, and the threshold, or setting at least one of the pulse width of pulse voltage, the generation interval of the pulse voltage, the number of times of consecutive application of the pulse voltage, the reference value, and the threshold. In addition, if the parameter setting device 10 sets the parameters in accordance with the statistical value calculation method selected by the statistical value selector 9, it is possible to perform failure detection with higher accuracy.

In the fire alarm system 100*a* according to the second embodiment shown in FIG. 2, both of the statistical value selector 9 and the parameter setting device 10 are provided as an example. However, only one of the statistical value selector 9 or the parameter setting device 10 may be provided.

Third Embodiment

Figure 3:
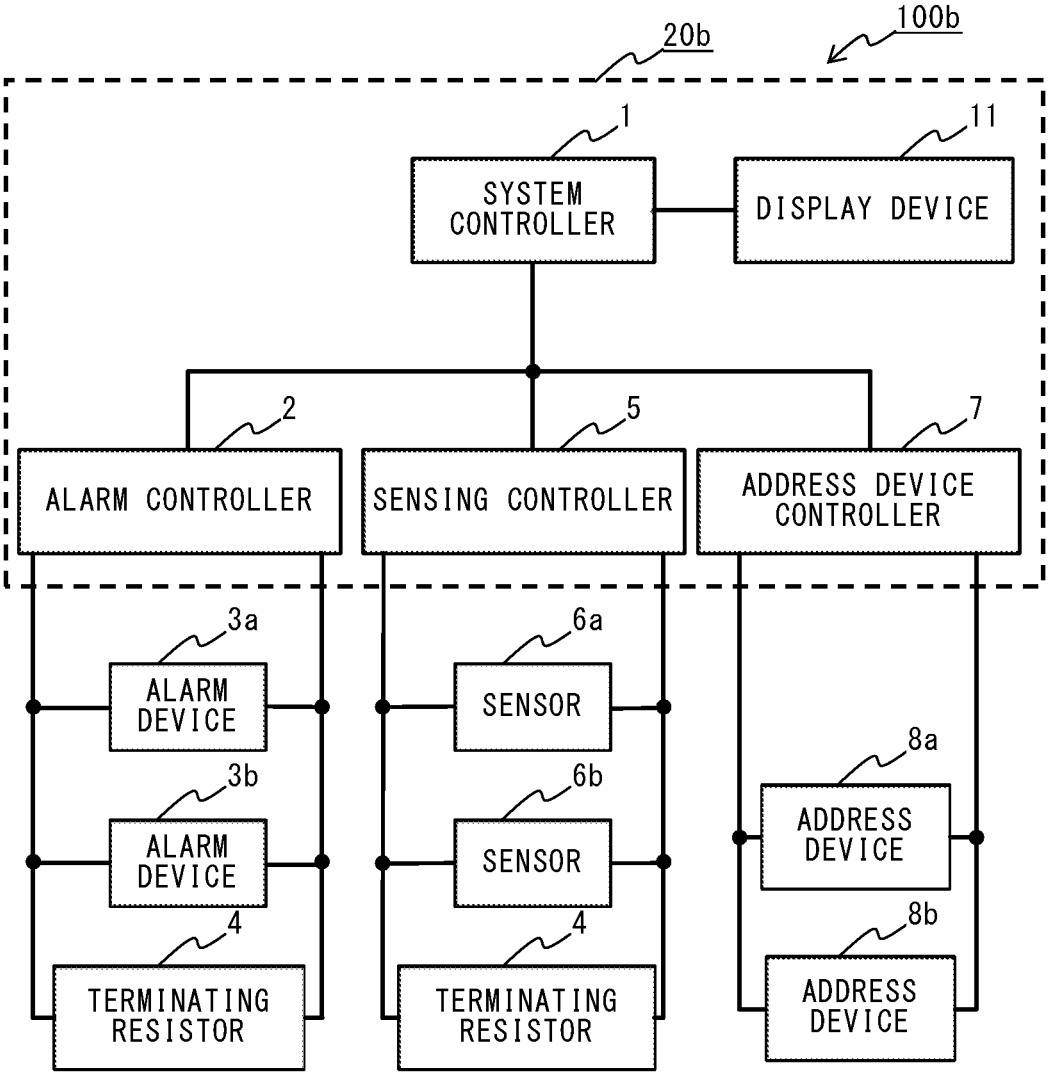
FIG. 3 is a block diagram showing the configuration of a fire alarm system according to the third embodiment of the present disclosure.

FIG. 3 is a diagram showing the configuration of a fire alarm system 100*b* according to the third embodiment of the present disclosure. In the fire alarm system 100*b* according to the third embodiment shown in FIG. 3, as compared to the fire alarm system 100 according to the first embodiment shown in FIG. 1, the control panel 20 is replaced with a control panel 20*b* and a display device 11 is added. The other configuration of the fire alarm system 100*b* according to the third embodiment is the same as the configuration of the fire alarm system 100 according to the first embodiment.

In the fire alarm system 100*b* according to the third embodiment shown in FIG. 3, the system controller 1 acquires the statistical value calculated in failure diagnosis, from the alarm controller 2, and displays the statistical value on the display device 11. Thus, the user can confirm the statistical value of power consumptions of the alarm device, whereby it is possible to confirm how far the statistical value is away from the reference value even when the statistical value is within the threshold range and determined as normal. Further, when it is determined that failure has occurred, it is possible to confirm how far the statistical value exceeds the threshold.

In addition, the calculated statistical values may be stored and the record of a plurality of statistical values in the past may be displayed on the display device 11. As a display manner of the record of the statistical values, numerical values may be arranged in series, or a graph or the like may be used. By displaying the record of the statistical values, it becomes easy to confirm change in the statistical values, so that a sign of deterioration of the alarm device can be readily found.

It is noted that the following may be displayed on the display device 11. When determination has been made as failure or normal in the alarm controller 2, the determination result may be displayed. Which of the average value, the maximum value, and the minimum value is required as the statistical value may be displayed. At least one of the pulse width of pulse voltage, the generation interval of the pulse voltage, the number of times of consecutive application of the pulse voltage, the reference value, and the threshold may be displayed. For example, if the record of the statistical values is indicated by a graph and the reference value and the threshold are also indicated on the graph, for example, when the statistical value comes close to the threshold while being away from the reference value, this can be confirmed from the graph, so that a sign of deterioration of the alarm device can be more readily found.

The fire alarm system 100*b* according to the third embodiment shown in FIG. 3 may further include the statistical value selector 9 and the parameter setting device 10 shown in FIG. 2. In this case, it is possible to obtain the effects of the second embodiment in addition to the effects of the third embodiment.

Figure 4:
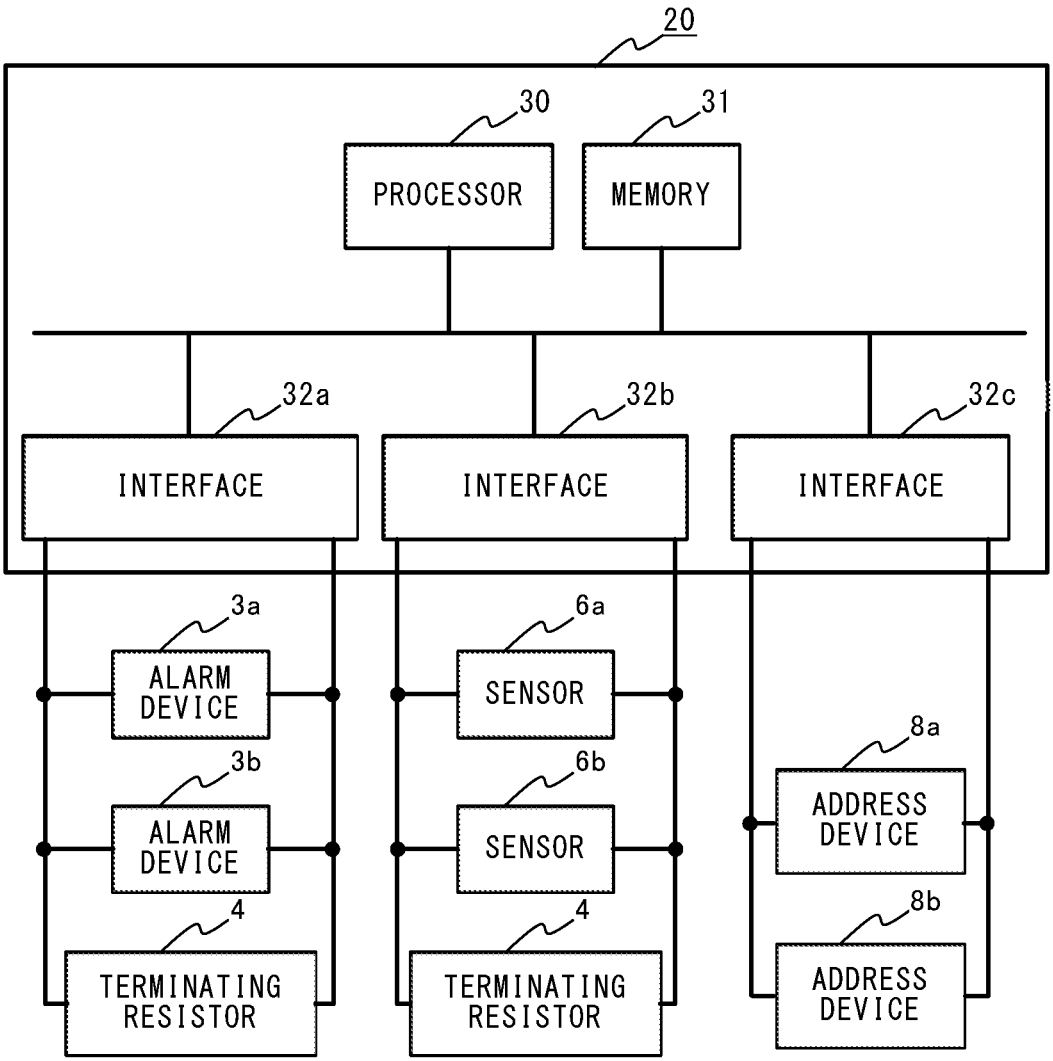
FIG. 4 is a diagram showing an example of the hardware configuration of the fire alarm system according to the first embodiment.

FIG. 4 is a schematic view showing an example of hardware of the control panel 20 in the fire alarm system according to the first embodiment. The system controller 1 is realized by a processor 30 such as a CPU or a system LSI for executing a program stored in a memory 31. The alarm controller 2 is realized by the processor 30 such as a CPU or a system LSI for executing a program stored in the memory 31, and an interface 32*a*. The sensing controller 5 is realized by the processor 30 such as a CPU or a system LSI for executing a program stored in the memory 31, and an interface 32*b*. The address device controller 7 is realized by the processor 30 such as a CPU or a system LSI for executing a program stored in the memory 31, and an interface 32*c*. Each function may be executed through coordination by a plurality of processing circuits.

Figure 5:
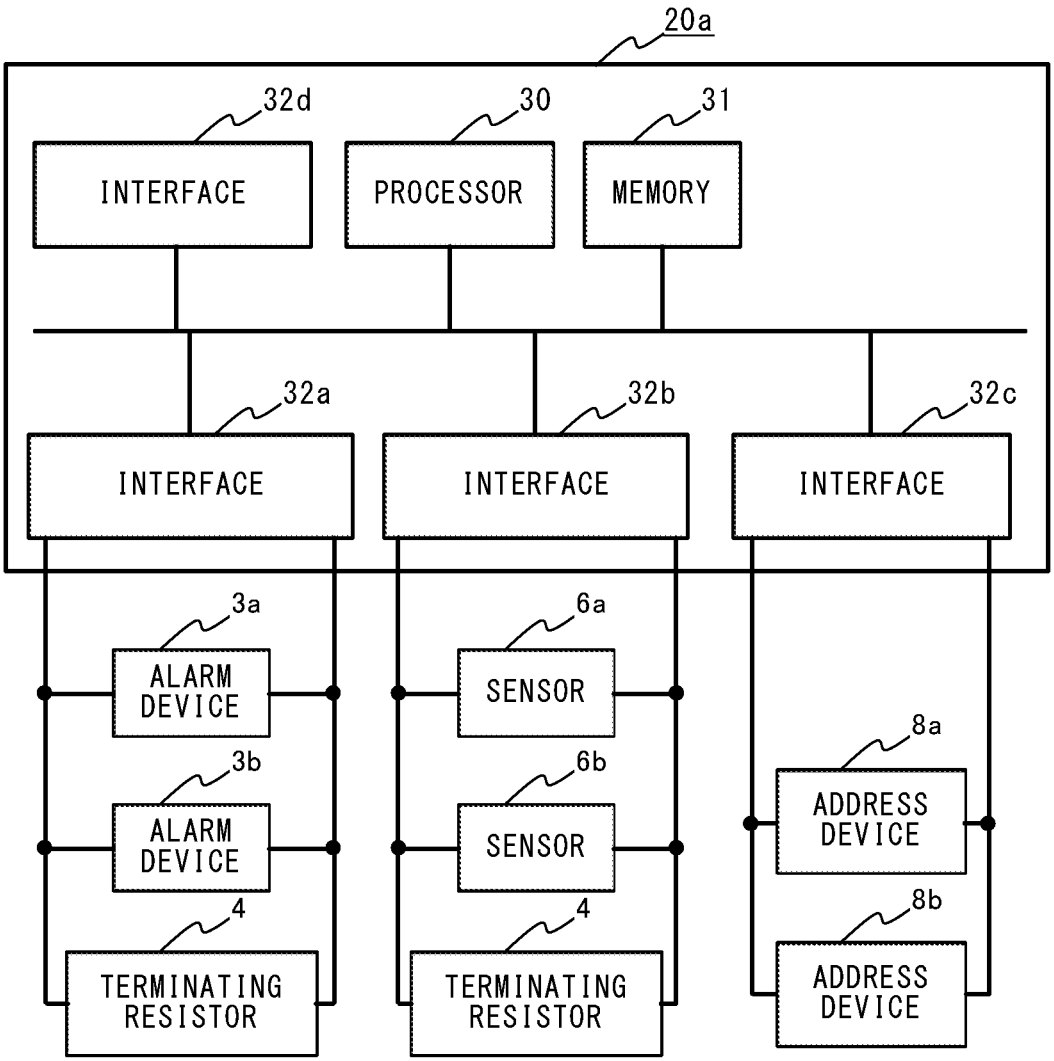
FIG. 5 is a diagram showing an example of the hardware configuration of the fire alarm system according to the second embodiment.

FIG. 5 is a schematic diagram showing an example of hardware of the control panel 20*a* in the fire alarm system according to the second embodiment. Hardware of the system controller 1, the alarm controller 2, the sensing controller 5, and the address device controller 7 is the same as the hardware of the control panel 20 in the fire alarm system according to the first embodiment shown in FIG. 4. The statistical value selector 9 and the parameter setting device 10 are realized by an interface 32*d* which is an input device such as a keyboard, a switch, or a touch panel.

Figure 6:
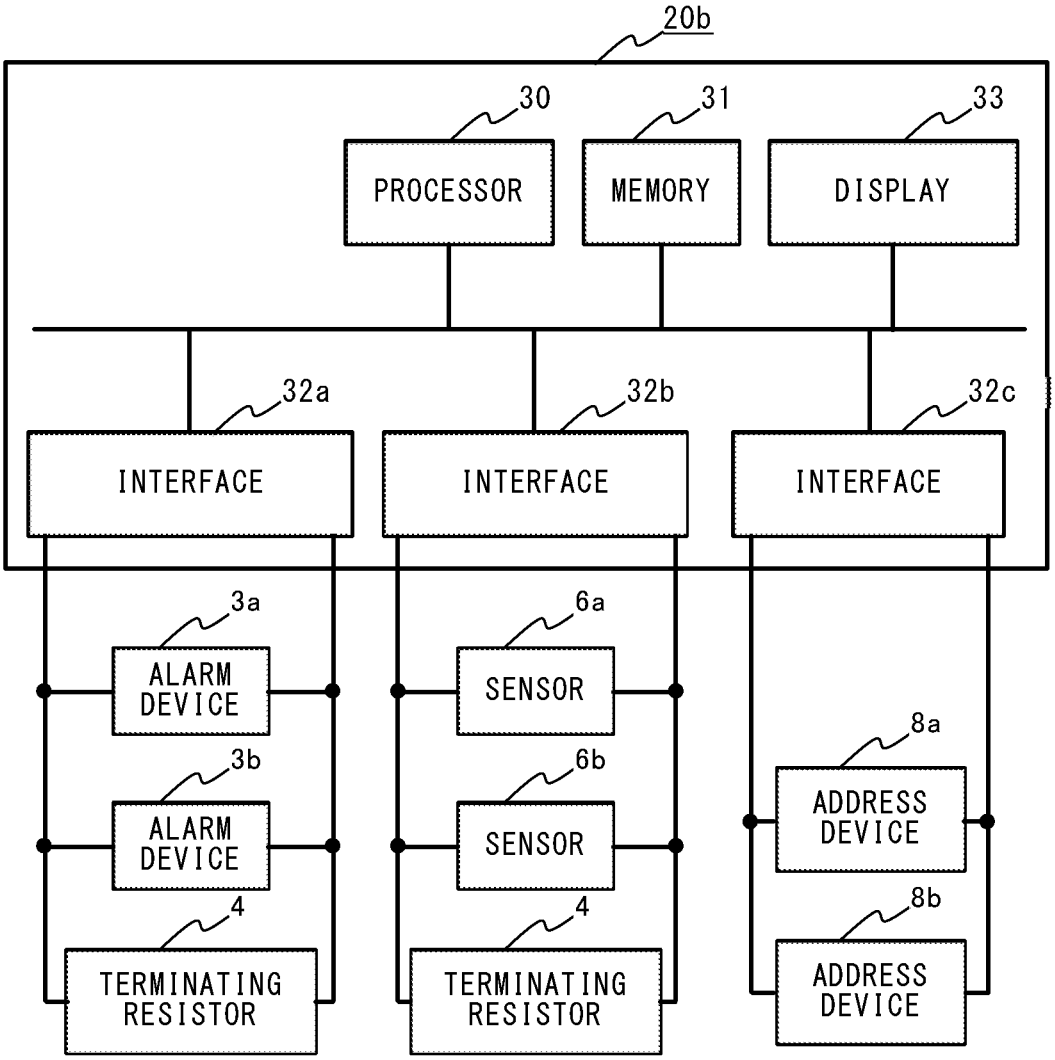
FIG. 6 is a diagram showing an example of the hardware configuration of the fire alarm system according to the third embodiment.

FIG. 6 is a schematic diagram showing an example of hardware of a control panel 20*b* in the fire alarm system according to the third embodiment. Hardware of the system controller 1, the alarm controller 2, the sensing controller 5, and the address device controller 7 is the same as the hardware of the control panel 20 in the fire alarm system according to the first embodiment shown in FIG. 4. The display device 11 is realized by a display 33.

Although the disclosure is described above in terms of various exemplary embodiments and implementations, it should be understood that the various features, aspects, and functionality described in one or more of the individual embodiments are not limited in their applicability to the particular embodiment with which they are described, but instead can be applied, alone or in various combinations to one or more of the embodiments of the disclosure.

It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

DESCRIPTION OF THE REFERENCE CHARACTERS

1 system controller
2 alarm controller
3*a*, 3*b* alarm device
4 terminating resistor
5 sensing controller
6*a*, 6*b* sensor
7 address device controller
8*a*, 8*b* address device
9 statistical value selector
10 parameter setting device
11 display device
20, 20*a*, 20*b* control panel
30 processor
31 memory
32*a*, 32*b*, 32*c*, 32*d* interface
33 display
100, 100*a*, 100*b* fire alarm system

What is claimed is:

1. A fire alarm system comprising:
an alarm device for issuing an alarm; and
an alarm controller for applying voltage to the alarm device, wherein
the alarm controller
applies pulse voltage to the alarm device a plurality of times consecutively, the pulse voltage having such a short time length that the alarm device does not issue a noticeable alarm,
measures power consumption for each of the pulse voltages,
calculates, as a statistical value, any of an average value of the plurality of power consumptions, a maximum value of the plurality of power consumptions, or a minimum value of the plurality of power consumptions, and
when a difference between the statistical value and a predetermined reference value is greater than a predetermined threshold, determines that failure has occurred.

2. The fire alarm system according to claim 1, configured to perform failure diagnosis a plurality of times, wherein
when a calculation method for the statistical value is the same as a calculation method for a statistical value in failure diagnosis in which determination has been made as normal at a previous time, the statistical value calculated in the failure diagnosis in which determination has been made as normal at the previous time is used as the reference value.

3. The fire alarm system according to claim 2, further comprising a parameter setting device for setting at least one of a pulse width of the pulse voltage, a generation interval of the pulse voltage, a number of times of consecutive application of the pulse voltage, and the threshold.

4. The fire alarm system according to claim 1, further comprising a parameter setting device for setting at least one of a pulse width of the pulse voltage, a generation interval of the pulse voltage, a number of times of consecutive application of the pulse voltage, the reference value, and the threshold.

5. The fire alarm system according to claim 1, further comprising a statistical value selector for selecting, as the statistical value, any of the average value of the plurality of power consumptions, the maximum value of the plurality of power consumptions, and the minimum value of the plurality of power consumptions.

6. The fire alarm system according to claim 1, further comprising a display device for displaying the statistical value.

7. The fire alarm system according to claim 6, wherein the display device displays a record of the statistical value.

* * * * *